US007448362B2

(12) United States Patent
Seelbach

(10) Patent No.: US 7,448,362 B2
(45) Date of Patent: Nov. 11, 2008

(54) CONDUIT ARRANGEMENT IN A CONTROL VALVE MODULE FOR A FUEL INJECTOR ASSEMBLY

(75) Inventor: Klaus Seelbach, Kleinbundenbach (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/595,028

(22) PCT Filed: Jun. 30, 2003

(86) PCT No.: PCT/US03/20641

§ 371 (c)(1),
(2), (4) Date: May 15, 2007

(87) PCT Pub. No.: WO2005/010346

PCT Pub. Date: Feb. 3, 2005

(65) Prior Publication Data

US 2008/0047526 A1 Feb. 28, 2008

(51) Int. Cl.
*F02M 59/46* (2006.01)
*F02M 59/48* (2006.01)

(52) U.S. Cl. ..... 123/467; 123/468

(58) Field of Classification Search ..... 123/446, 123/467, 468, 469; 239/88–92, 96, 533.2, 239/533.9

See application file for complete search history.

(56) References Cited

U.S. PATENT DOCUMENTS

| | | | | |
|---|---|---|---|---|
| 4,782,807 | A | 11/1988 | Takahashi | |
| 6,059,203 | A * | 5/2000 | Streicher et al. | 239/533.2 |
| 6,196,199 | B1 * | 3/2001 | Jiang | 123/506 |
| 6,565,020 | B1 | 5/2003 | Helsel et al. | |
| 6,758,415 | B2 * | 7/2004 | Fischer et al. | 239/533.2 |
| 2003/0111049 | A1 * | 6/2003 | Lewis | 123/446 |
| 2003/0127532 | A1 * | 7/2003 | Coldren et al. | 239/5 |
| 2004/0021008 | A1 * | 2/2004 | Fischer et al. | 239/533.2 |

* cited by examiner

*Primary Examiner*—Mahmoud Gimie
(74) *Attorney, Agent, or Firm*—McGarry Bair PC

(57) ABSTRACT

A control valve module (14') for a fuel injector assembly (10) has a conduit arrangement where a high-pressure passage (108) has a first portion (110) extending linearly between an annulus (106) surrounding the control valve cylinder (42) and an upper edge (34), and a second portion (112) extending linearly between the annulus (106) and a lower edge (35').

5 Claims, 2 Drawing Sheets

CONDUIT ARRANGEMENT IN A CONTROL VALVE MODULE FOR A FUEL INJECTOR ASSEMBLY

CROSS-REFERENCE TO RELATED APPLICATIONS

This application claims priority on International Application No. PCT/US2003/020641, filed Jun. 30, 2003.

BACKGROUND OF THE INVENTION

1. Field of the Invention

The invention relates to fuel injector assemblies for internal combustion engines, and more particularly to the arrangement of conduits within fuel injector assemblies.

2. Description of the Related Art

A fuel injector assembly of well-known design, including a fuel injection pump and a control valve self-contained in a unit, is illustrated in FIG. 1. The fuel injector assembly 10 comprises a pump module 12, a control valve module 14, a spring cage assembly 16, a nozzle assembly 18, and a nozzle nut 20.

The pump module 12 comprises a pump body 22 with a central pumping cylinder 24 that receives a plunger 26. The cylinder 24 and the plunger 26 define a high-pressure cavity 28. In a well-known manner, the plunger 26 reciprocates within the cylinder 24 to increase fuel pressure in the high-pressure cavity 28. This action distributes pressurized fuel into a high-pressure passage 30 that exits at a face 31 in a large recess 33, formed in a lower end of the pump body 22.

The high-pressure passage 30 communicates with a high-pressure passage 32 in the control valve module 14 because an upper portion of the control valve module 14 is received within the large recess 33 so that an upper edge 34 of the control valve module 14 abuts the face 31 of the large recess. The face 31 requires a precision grinding process to insure the necessary flatness for a metal-to-metal seal. The high-pressure passage 32 extends generally linearly from the upper edge 34 to a lower edge 35 of the control valve module 14. A stator assembly 36 is centered within a recess 38 at the upper edge 34. A control valve 40 extends from the stator assembly 36 within a cylindrical chamber 42, and reciprocates in response to the respective forces of the stator assembly 36 and a spring 44. A high-pressure annulus 46 surrounding the control valve 40 is in communication with the high-pressure passage 32 by way of a cross passage 62.

At least one low-pressure passage or spill bore 48 extends from the cylindrical chamber 42 to a side edge of the control valve module 14 and communicates with a low-pressure reservoir 50 between the nozzle nut 20 and the control valve module 14. In a closed position, the control valve 40 blocks communication between the high-pressure passage 32 and the low-pressure passage 48. In an open position, the control valve 40 permits communication between the high-pressure passage 32 and the low-pressure passage 48.

A high-pressure passage 52 in the spring cage assembly 16 communicates at one end with the high-pressure passage 32 and at the other end with a high-pressure passage 54 in a stop plate 56. The high-pressure passage 54, in turn, connects with a passage 58 in the nozzle assembly 18. The nozzle nut 20 threadably attaches to the pump body 22 at a junction 60 and secures the nozzle assembly 18, stop plate 56, spring cage assembly 16, and control valve module 14 to the pump body 22. It has been found that the junction 60 is a point where fractures can occur because the axial flange forming the large recess 33 is a point of weakness.

In the present design, the high-pressure annulus 46 and the high-pressure passage 32 in the control valve module 14 are formed by drilling, followed by at least two electrochemical machining (ECM) procedures. The primary function of using an ECM process is to smooth sharp edges and burrs resulting from drilling or machining, thereby strengthening the control valve module. The cross passage 62 is drilled through the control valve module 14 to a T-connection with the high-pressure passage 32. A first ECM process at the T-connection has the effect of slightly enlarging the T-connection. A second ECM process is also used to form the high-pressure annulus 46. Thereafter, a plug or pin 64 (typically made of a shape memory alloy) is disposed in the cross passage 62 between the high-pressure annulus 46 and the edge of the control valve module 14. Also, the requirement for centering the stator assembly 36 in the recess 38 and the necessary for flatness in the metal-to-metal seal with the face 31 requires a precision grinding operation to maintain critical tolerances.

These processes are costly and time-consuming. There is a need to improve the ease and to lower the cost of manufacture, as well as to continually improve the performance of the control valve module during injection events.

SUMMARY OF THE INVENTION

These problems and others are solved by the present invention of a control valve module for a fuel injector assembly for an internal combustion engine. The fuel injector assembly is the type having a pump body with a high-pressure passage and a spring cage assembly with a high-pressure passage. The control valve module is adapted to be interposed between the pump body, with an upper edge facing the pump body and a lower edge facing the spring cage assembly. The control valve module further has a recess to accommodate at least a portion of a stator assembly with a cylindrical chamber extending into the valve module. An annulus surrounds the cylindrical chamber, and the control valve module has a high-pressure passage. According to the invention, the control valve high-pressure passage has a first portion extending linearly between the annulus and the upper edge where it is positioned to communicate with the pump body high-pressure passage, and a second portion extending linearly between the annulus and the lower edge where it is positioned to communicate with the spring cage assembly high-pressure passage.

Preferably, the first portion and second portion extend relative to each other at an angle other than 180 degrees. Also, the pump body can be provided with a facing recess with clearance to accommodate at least a portion of the stator assembly so that the recess and the facing recess fully enclose and retain the stator assembly when the control valve module is assembled to the pump body.

In another aspect of the invention, a fuel injector assembly for an internal combustion engine comprises a pump body with a high-pressure passage, a spring cage assembly with a high-pressure passage, and a control valve module between the pump body and the spring cage assembly. The control valve module has an upper edge facing the pump body and a lower edge facing the spring cage assembly, and a recess to accommodate at least a portion of a stator assembly with a cylindrical chamber extending into the valve module. An annulus surrounds the cylindrical chamber. A high-pressure passage is characterized by a first portion extending linearly between the annulus and the upper edge where it is positioned to communicate with the pump body high-pressure passage, and a second portion extending linearly between the annulus and the lower edge where it is positioned to communicate with the spring cage assembly high-pressure passage.

The pump body can have a facing recess with clearance to accommodate at least a portion of the stator assembly so that the recess and the facing recess fully enclose and retain the stator assembly. Moreover, the first portion and the second portion preferably extend relative to each other at an angle other than 180 degrees.

In a further aspect of the invention, a method of making a control valve module for a fuel injector assembly for an internal combustion engine comprises the steps of:

providing a metal block with a machined upper edge and machined lower edge;

machining a recess into the upper edge with a cylindrical chamber extending therefrom;

drilling a first portion of a conduit from the upper edge to an intersection point at the cylindrical chamber;

drilling a second portion of a conduit from the lower edge to the intersection point; and electro chemically machining an annulus surrounding the cylindrical chamber at the intersection point.

DESCRIPTION OF THE PREFERRED EMBODIMENT

Figure 1:
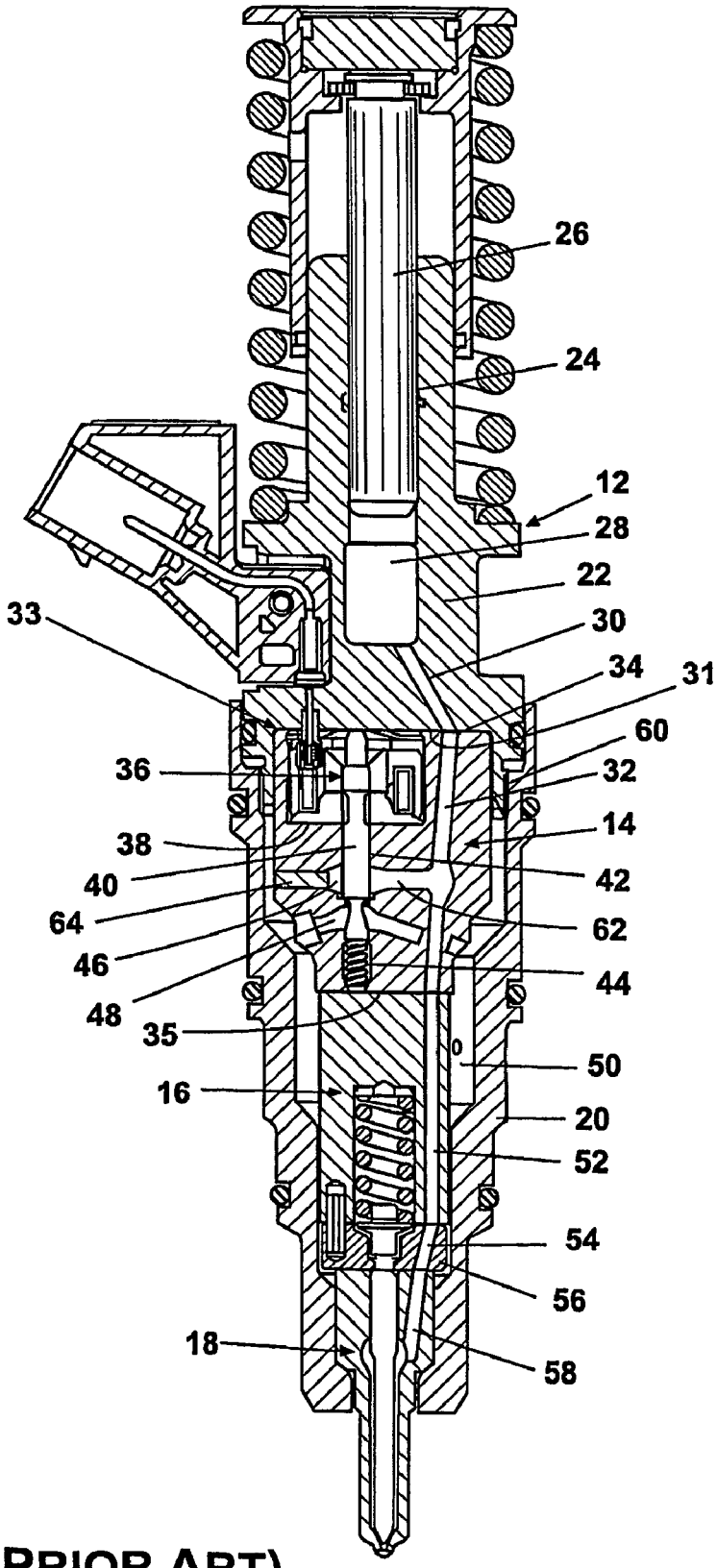
Fig. 1 (PRIOR ART)
FIG. 1 is a cross-sectional view of a fuel injector assembly in the prior art.
Figure 2:
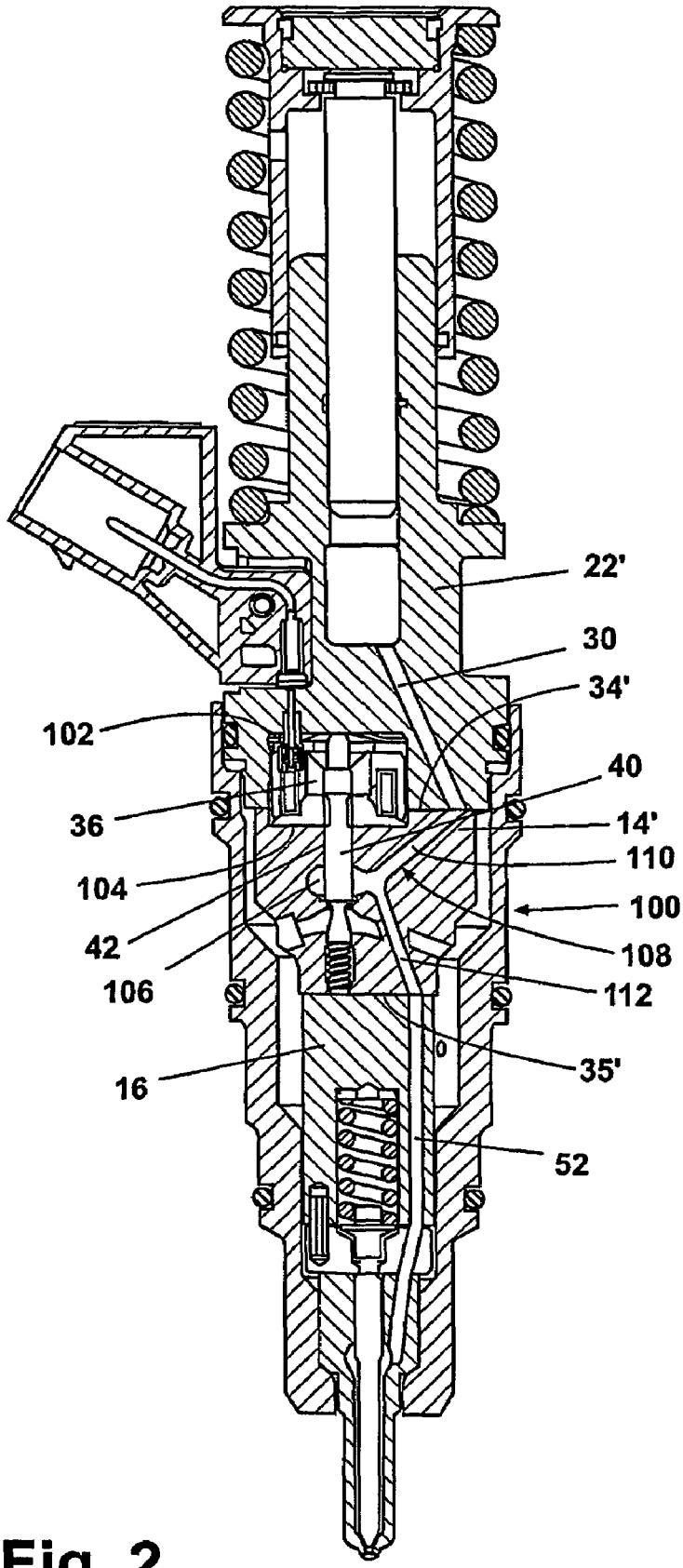
FIG. 2 is a cross-sectional view of a fuel injector assembly incorporating the present invention.

Looking now more closely at FIG. 2, it can be seen that the overall relative arrangement of conventional components in the fuel injector assembly of FIG. 1 remains. Consequently like components will bear like reference numerals to those of FIG. 1. Turning now to the invention, it will be apparent that a conduit arrangement 100 in the control valve module 14' is new. Moreover, the interface between the pump body 22' and the control valve module 14' is new. The large recess 33 in which the control valve module 14 is received in the fuel injector assembly of the prior art is eliminated. A smaller recess 102 is provided in the pump body 22' with clearance to accommodate enclosing a portion of the stator assembly 36. A facing recess 104 in the upper edge 34' of the control valve module 14' cooperates with the recess 102 to completely enclose the stator assembly 36. A high-pressure annulus 106 surrounds and is in communication with the cylindrical chamber 42 containing the control valve 40. A high-pressure passage 108 comprises a first portion 110 extending linearly between the upper edge 34', where it communicates with the high-pressure passage 30 in the pump body 22', and the high-pressure annulus 106. The high-pressure passage 108 also comprises a second portion 112 extending linearly between the high-pressure annulus 106 and the lower edge 35' of the control valve module 14', where it communicates with the high-pressure passage 52 in the spring cage assembly 16.

Manufacture of the pump body and the control valve module are simpler because of the invention. Conventional machining processes can form the facing recess 104 and the cylindrical chamber 42, as well as the upper edge 34'. Precision machining is unnecessary because the recess 102 and facing recess 104 are adequate to center the stator assembly 36. Conventional machining and grinding are adequate to obtain the necessary tolerances for the upper edge 34' on the control valve module 14'.

Formation of the conduit arrangement 100 can be accomplished by drilling at an oblique angle from the upper edge 34' to a point where the high-pressure annulus 106 is to be formed at an intersection with the cylindrical chamber 42, and also drilling at an oblique angle from the lower edge 35' to the same point. Applying a single ECM process at the intersection will form the high-pressure annulus 106.

It can be seen that the conduit arrangement 100 according to the invention enables a simpler and less costly manufacturing process. It eliminates the need for drilling and reaming a close tolerance cross passage, and then plugging the passage. It also eliminates one ECM process. It further eliminates a precision grinding process, otherwise required in the large recess 33. It has been found that with a new conduit arrangement 100 according to the invention, hydraulic performance is improved, strength of the junction of the nozzle nut with the pump body is increased, and electrical connections to the stator assembly can be made more easily and securely during assembly.

While the invention has been specifically described in connection with certain specific embodiments thereof, it is to be understood that this is by way of illustration and not of limitation, and the scope of the appended claims should be construed as broadly as the prior art will permit.

What is claimed is:

1. A control valve module for a fuel injector assembly for an internal combustion engine, the fuel injector assembly having a pump body with a high-pressure passage and a spring cage assembly with a high-pressure passage, wherein the control valve module is adapted to be interposed between the pump body, with an upper edge facing the pump body and a lower edge facing the spring cage assembly, and wherein the control valve module further has a facing recess to accommodate at least a portion of a stator assembly with a cylindrical chamber extending into the valve module from the facing recess, with an annulus surrounding the cylindrical chamber, and with a high-pressure passage, characterized by:

the control valve high-pressure passage having a first portion extending linearly between the annulus and the upper edge where it is positioned to communicate with the pump body high-pressure passage, and a second portion extending linearly between the annulus and the lower edge where it is positioned to communicate with the spring cage assembly high-pressure passage wherein the first portion and second portion extend relative to each other at an angle other than 180 degrees.

2. A control valve module according to claim 1 wherein the pump body is provided with a recess to accommodate at least portion of the stator assembly so that the recess and the facing recess fully enclose and retain the stator assembly when the control valve module is assembled to the pump body.

3. A fuel injector assembly for an internal combustion engine, the fuel injector assembly having a pump body with a high-pressure passage, a spring cage assembly with a high-pressure passage, and a control valve module between the pump body and the spring cage assembly, with an upper edge facing the pump body and a lower edge facing the spring cage assembly, and wherein the control valve module has a facing recess to accommodate at least a portion of a stator assembly with a cylindrical chamber extending into the valve module from the facing recess, with an annulus surrounding the cylindrical chamber, and with a high-pressure passage, characterized by:

the control valve high-pressure passage having a first portion extending linearly between the annulus and the upper edge where it is positioned to communicate with the pump body high-pressure passage, and a second portion extending linearly between the annulus and the lower edge where it is positioned to communicate with the spring cage assembly high-pressure passage wherein the first portion and second portion extend relative to each other at an angle other than 180 degrees.

4. A fuel injector assembly according to claim 3 wherein the pump body has a recess to accommodate at least portion of the stator assembly so that the recess and the facing recess fully enclose and retain the stator assembly.

5. A method of making a control valve module for a fuel injector assembly for an internal combustion engine comprising the steps of:

providing a metal block with a machined upper edge and machined lower edge;

machining a facing recess into the upper edge with a cylindrical chamber extending therefrom;

drilling a first portion of a conduit from the upper edge to an intersection point at the cylindrical chamber;

drilling a second portion of a conduit from the lower edge to the intersection point; and electro chemically machining an annulus surrounding the cylindrical chamber at the intersection point.

* * * * *